US007665612B2

(12) United States Patent
Turner

(10) Patent No.: US 7,665,612 B2
(45) Date of Patent: Feb. 23, 2010

(54) MULTI-ROLL GIFT WRAP ENSEMBLE

(75) Inventor: Gary L. Turner, Olive Branch, MS (US)

(73) Assignee: Cleo Inc., Memphis, TN (US)

( * ) Notice: Subject to any disclaimer, the term of this patent is extended or adjusted under 35 U.S.C. 154(b) by 480 days.

(21) Appl. No.: 11/645,221

(22) Filed: Dec. 21, 2006

(65) Prior Publication Data

US 2007/0163907 A1 Jul. 19, 2007

Related U.S. Application Data

(60) Provisional application No. 60/753,952, filed on Dec. 23, 2005.

(51) Int. Cl.
*B65D 69/00* (2006.01)

(52) U.S. Cl. ..... 206/575; 206/410; 206/416; 206/443; 206/497

(58) Field of Classification Search ..... 206/389, 206/391–394, 225, 408, 410, 416, 443, 446, 206/497, 575; 242/613, 613.5
See application file for complete search history.

(56) References Cited

U.S. PATENT DOCUMENTS

| | | | | |
|---|---|---|---|---|
| 1,809,267 | A | 6/1931 | Cushing | |
| 1,861,294 | A | 5/1932 | Bartlett | |
| 2,866,540 | A | 12/1958 | Rothauser | |
| 3,132,784 | A * | 5/1964 | Cohen et al. | 225/37 |
| D205,276 | S | 7/1966 | Kort | |
| 3,441,127 | A * | 4/1969 | Manning | 206/225 |
| 4,033,455 | A * | 7/1977 | Robison | 206/391 |
| 4,291,803 | A | 9/1981 | Perales | |
| 4,369,929 | A | 1/1983 | Cayer | |
| 4,934,575 | A * | 6/1990 | Mustafa | 225/38 |
| 5,337,895 | A | 8/1994 | Mitelman et al. | |
| 5,829,592 | A | 11/1998 | Henry, Jr. et al. | |
| 5,941,476 | A | 8/1999 | Copass | |
| 5,960,954 | A | 10/1999 | Seybold | |
| 2001/0040111 | A1 * | 11/2001 | Spradlin et al. | 206/391 |
| 2005/0127083 | A1 * | 6/2005 | Russell | 221/30 |
| 2005/0150924 | A1 * | 7/2005 | May et al. | 225/93 |
| 2006/0096937 | A1 * | 5/2006 | Schaefer | 211/165 |

FOREIGN PATENT DOCUMENTS

| | | | |
|---|---|---|---|
| GB | 2380178 | * | 4/2003 |

* cited by examiner

*Primary Examiner*—Luan K Bui
(74) *Attorney, Agent, or Firm*—McCarter & English, LLP

(57) ABSTRACT

Disclosed herein is a gift wrap ensemble that includes a first end cap and a second end cap. Each of the first and second end caps includes a base member and a plurality of depressions extending therefrom. A plurality of gift wrap rolls are provided that form a chamber therebetween and that receive the depressions. A decorative item, such as a ribbon, bow, tissue paper and/or a gift tag, is positioned within the chamber. Packaging such as shrink wrap, a container, etc. encloses the decorative item within the chamber, and the decorative item is visually-perceptible from outside the packaging.

26 Claims, 14 Drawing Sheets

MULTI-ROLL GIFT WRAP ENSEMBLE

CROSS-REFERENCE TO RELATED APPLICATIONS

The present application claims the benefit of U.S. Provisional Application No. 60/753,952 filed Dec. 23, 2005, which is hereby incorporated by reference in its entirety for all purposes.

FIELD OF THE INVENTION

The present invention relates to a gift wrap ensemble, and, more particularly, to a gift wrap ensemble having end caps for engaging a plurality of gift wrap rolls.

BACKGROUND OF THE INVENTION

Gift wrap is typically packaged as a long continuous paper sheet rolled onto a cylindrical cardboard tube, and decorative items, such as bows, ribbons, etc., are typically packaged and purchased separately therefrom. However, separate packaging impacts manufacturing costs and may inhibit sales, particularly with respect to those consumers who would prefer to purchase a single package at a lower cost. Furthermore, some packaging of the prior art is problematic, because the edges of the rolled gift wrap are typically exposed at the ends thereof so that the ends are vulnerable to being damaged during storage, handling, and shipping.

It is known in the art to use protective holders as packaging for the ends of rolled gift wrap. For example, U.S. Pat. No. 3,441,127 to Manning (the "Manning '127 Patent") discloses a gift wrapping ensemble having a holder adapted for engaging two rolls of gift wrap. The holder includes a rectangular frame that has members depending therefrom for retaining the two rolls of gift wrap. Each of the depending members frictionally engages one of the rolls. Although the Manning '127 Patent further provides that gift tags may be contained by the ensemble, the Manning '127 Patent teaches that the holder has a compartment formed as a part thereof and that the tags are contained within the small space of the compartment.

SUMMARY OF THE INVENTION

The present invention overcomes the disadvantages and shortcomings of the prior art discussed above by providing a multi-roll gift wrap ensemble that includes a plurality of gift wrap rolls and a plurality of end caps that form a friction fit with the gift wrap rolls so as to appropriately position them within packaging, such as shrink-wrap and/or a container that is typically formed from transparent plastic. In a multi-roll gift wrap ensemble constructed in accordance with an embodiment of the present invention, the end caps and the gift wrap rolls define a chamber therebetween, and the multi-roll gift wrap ensemble includes decorative items (e.g., bows, ribbons, etc.) positioned within the chamber. When the container is made from a transparent material, the gift wrap rolls and/or the decorative items are visible by a consumer at the point of purchase.

BRIEF DESCRIPTION OF THE DRAWINGS

For a more complete understanding of the present invention, reference is made to the following detailed description of several exemplary embodiments of the present invention considered in conjunction with the accompanying drawings, in which.

DETAILED DESCRIPTION OF THE INVENTION

Figure 1:
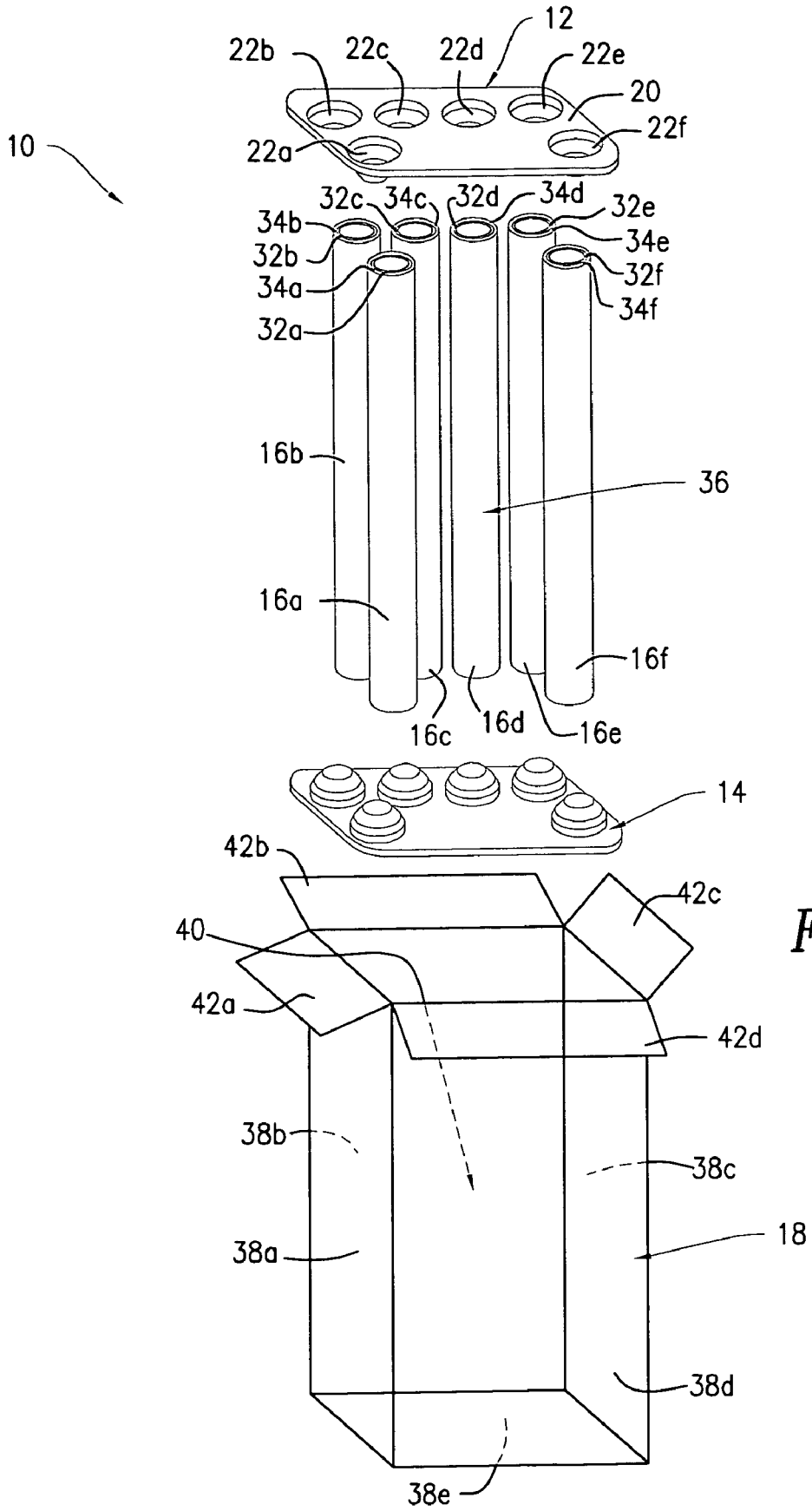
FIG. 1 is an exploded view of a multi-roll gift wrap ensemble constructed in accordance with a first exemplary embodiment of the present invention, the multi-roll gift wrap ensemble being shown to include end caps, gift wrap rolls, a chamber formed therebetween, and a transparent container.
Figure 2:
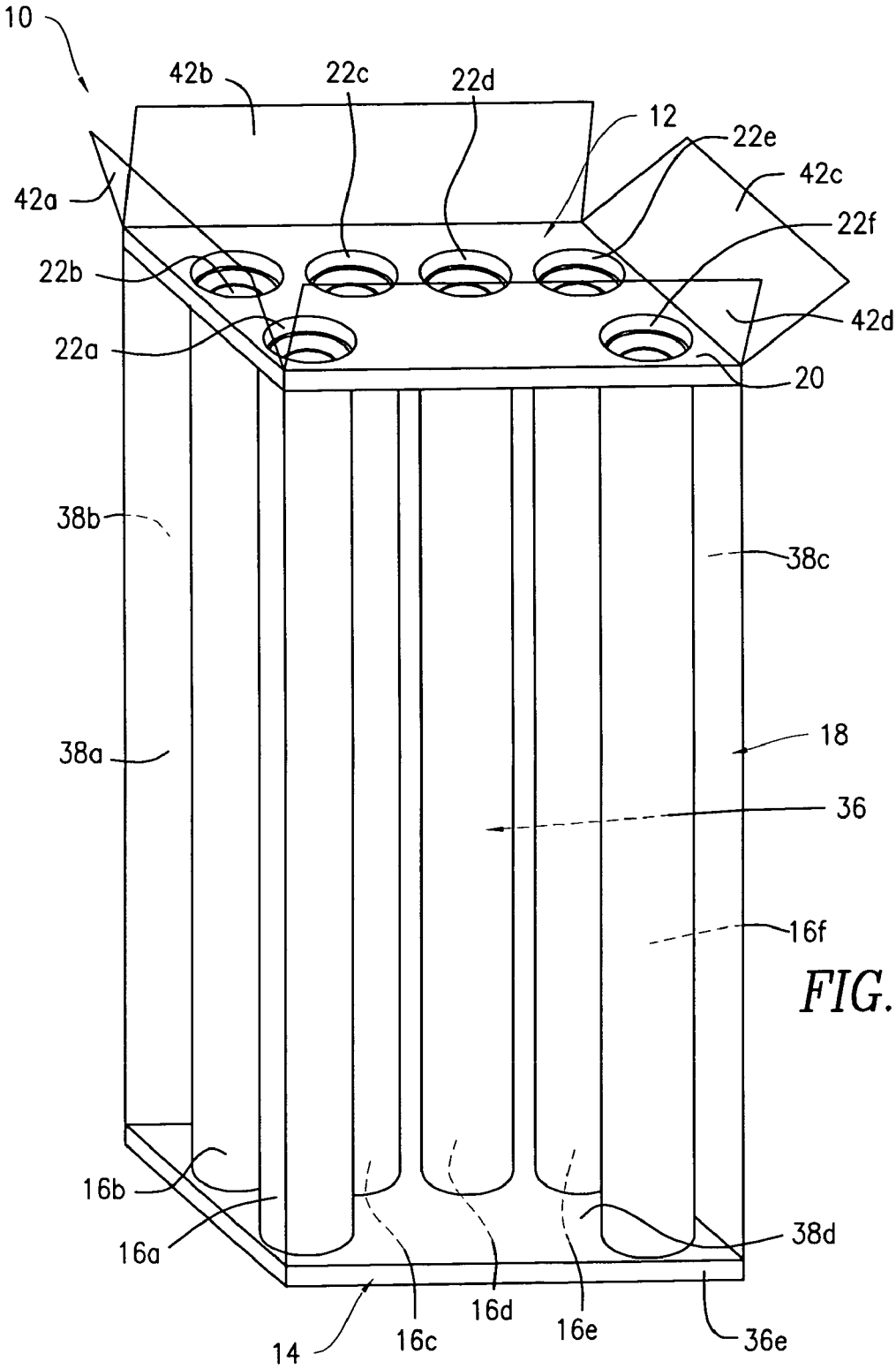
FIG. 2 is a perspective view of the multi-roll gift wrap ensemble of FIG. 1.

Referring to FIGS. 1-2, a multi-roll gift wrap ensemble 10 includes a pair of plastic end caps 12, 14, a plurality of gift wrap rolls 16*a-f*, and a container 18. Each of the end caps 12, 14, the gift wrap rolls 16*a-f*, and the container 18 shall be discussed in further detail below.

Figure 3:
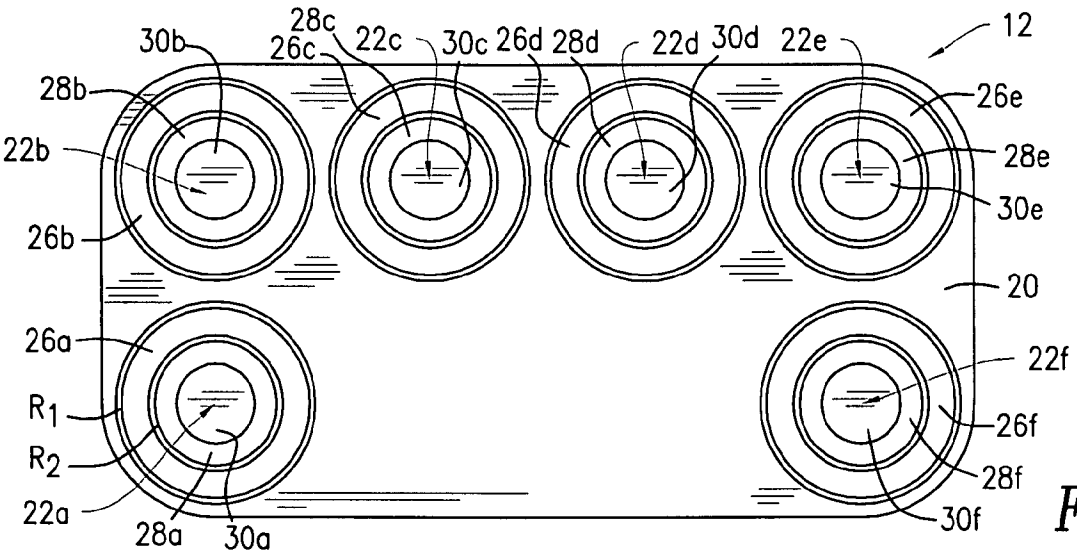
FIG. 3 is a top view of one of the end caps of FIG. 1.
Figure 4:
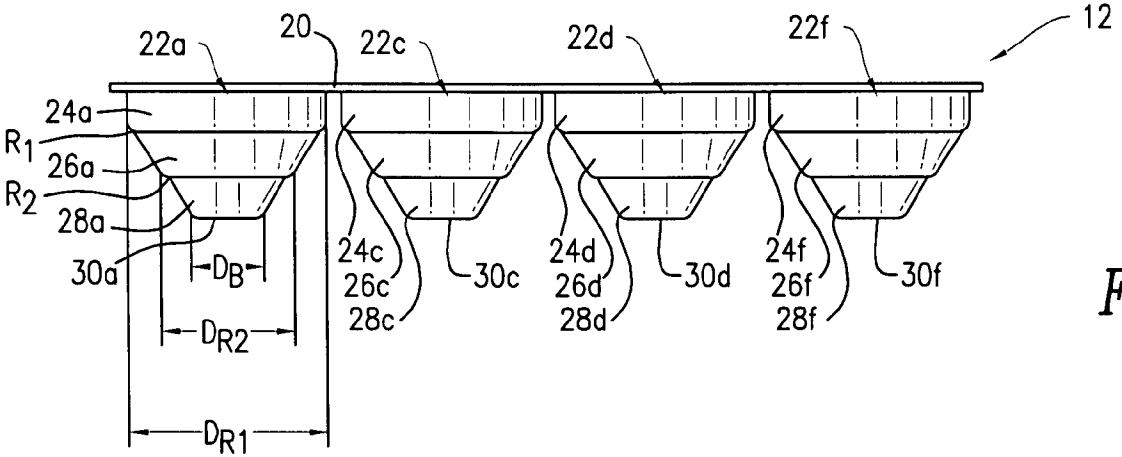
FIG. 4 is a front view of the end cap of FIG. 3.

Referring to FIGS. 3-4, the end caps 12, 14 shall now be discussed with exemplary reference to the end cap 12. It shall be clear to one skilled in the art that the below discussion of the end cap 12 is equally applicable to the end cap 14. However, as shown in FIGS. 1-2, the end cap 14 is inverted with respect to the end cap 12.

The end cap 12, which is preferably formed from plastic (e.g., PVC, HIPS, etc.), includes a base member 20 and a plurality of cup-like depressions 22*a-f* extending from the base member 20. The depressions 22*a-f* include cylindrical portions 24*a-f*, a first plurality of frustoconical portions 26*a-f*, a second plurality of frustoconical portions 28*a-f*, and a plurality of circular portions 30*a-f*. The depressions 22*a-f* shall be further discussed with exemplary reference to the depression 22*a*, and it shall be clear to one skilled in the art that the discussion of the depression 22*a* is equally applicable to the depressions 22*b -f* of the end cap 12 and the depressions (not designated) of the end cap 14.

The depression 22*a* extends from the base member 20 and is formed monolithically therewith. The depression 22*a* includes the cylindrical portion 24*a*, which extends from the base member 20, and the first frustoconical portion 26*a*, which extends from the cylindrical portion 24*a* and forms a ridge $R_1$ therewith. The depression 22*a* further includes the second frustoconical portion 28*a*, which extends from the first frustoconical portion 26*a* and forms a ridge $R_2$ therewith, and the circular portion 30*a*, which encloses the second frustoconical portion 28*a*. The diameter of the depression 22*a* decreases from the cylindrical portion 24*a* to the circular portion 30*a*, such that a diameter $D_{R1}$ at the ridge $R_1$ is greater than a diameter $D_{R2}$ at the ridge $R_2$, which is greater than a diameter $D_B$ at the circular portion 30*a*. Features of the depression 22*a* may be characterized as being stepped, tiered, conical, and/or tapered.

Figure 5:
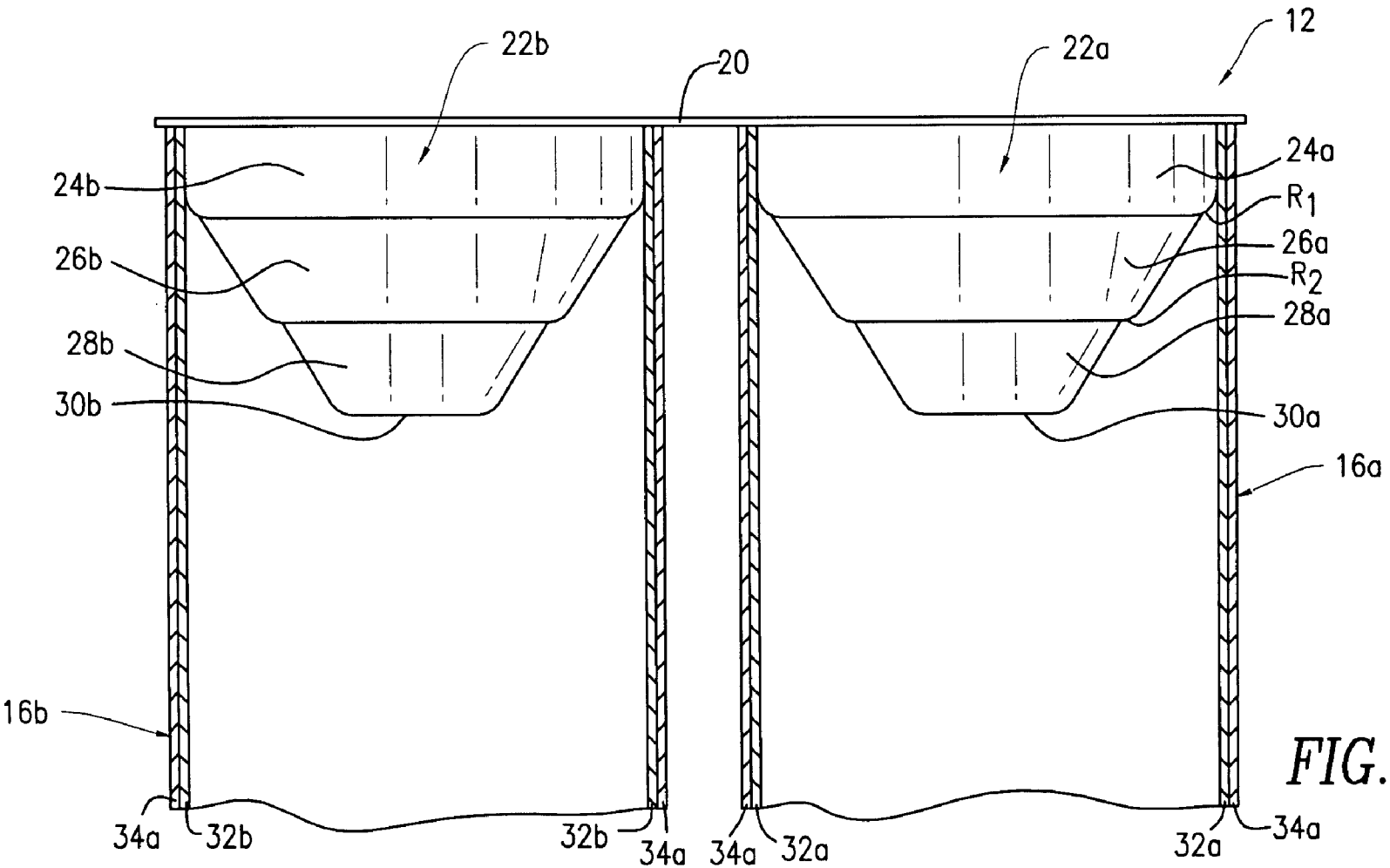
FIG. 5 is a left side view of the end cap of FIGS. 34 and a broken section of some of the gift wrap rolls shown along section line 5-5 of FIG. 1.

Referring to FIGS. 1-2 and 5, the gift wrap rolls 16*a-f* of the multi-roll gift wrap ensemble 10 shall now be discussed with further detail. Each one of the gift wrap rolls 16*a-f* includes a corresponding one of a plurality of cardboard tube cores 32*a-f* and gift wrap sheets 34*a-f* rolled thereabout. Each one of the gift wrap sheets 34*a-f* has one of a plurality of decorative patterns disposed thereon (not shown).

The outer diameter of each one of the gift wrap rolls 16*a-f* is dependent upon the unrolled length and thickness of the corresponding one of the gift wrap sheets 34*a-f*. Although the gift wrap rolls 16*a-f* are shown to have a consistent outer diameter, it is contemplated that each one of the gift wrap sheets can have an unrolled length and/or thickness different from each other one of the gift wrap sheets. In this regard, a manufacturer of the multi-roll gift wrap ensemble can mix and match gift wrap rolls of different outer diameters as desired, and each one of the depressions can be spaced from each other one of the depressions to accommodate same (e.g., by increasing the distance from the center of each depression to the center of each depression adjacent thereto to allow for thicker gift wrap rolls).

Referring to FIGS. 1-2 and 5, each one of the gift wrap rolls 16*a-f* extends between the end caps 12, 14, such that a chamber 36 is formed between the gift wrap rolls 16*a-f* and the end caps 12, 14. Each one of the cardboard tube cores 32*a-f* forms a friction fit with a corresponding one of the depressions 22*a-f* of the end cap 12 and another friction fit with a corresponding one of the depressions (not designated) of the end cap 14. To facilitate formation of the friction fits, the inner diameter of each one of the cardboard tube cores 32*a-f* is just greater than the diameter at the corresponding one of the cylindrical portions 24*a-f* (e.g., the diameter $D_{R1}$).

Referring to FIGS. 1-2, the packaging of the multi-roll gift wrap ensemble includes the container 18, which is shown to be formed from a transparent plastic material and can be formed from opaque and/or translucent material(s). The container 18 has a plurality of walls 38*a-e* defining an interior space 40 within the container 18 and further includes a plurality of lid flaps 42*a-d*. Each one of the lid flaps 42*a-d* is hingedly attached to one of the plurality of walls 38*a-d* corresponding thereto, and can fold so as to close the interior space 40. Each one of the lid flaps 42*a-d* can be secured to each other one of the lid flaps 42*a-d* with cellophane tape, for example, to maintain a closed position. The gift wrap rolls 16*a-f* and the end caps 12, 14 are positioned within the interior space 40 of the container 18.

Continuing with general reference to FIGS. 1-5, an exemplary method of assembling the multi-roll gift wrap ensemble 10 shall now be discussed with exemplary reference to the gift wrap roll 16*a* and the depression 22*a* of the end cap 12. It shall be clear to one skilled in the art that the discussion is equally applicable to the gift wrap rolls 16*b-f*, the depressions 22*b-f* of the end cap 12, and the depressions (not designated) of the end cap 14.

An assembler (e.g., a human operator and/or an automated machine system) inserts an end (not designated) of the gift wrap roll 16*a* into the depression 22*a*. Because the diameter $D_B$ at the circular portion 30*a* is less than the diameter $D_{R1}$ at the cylindrical portion 24*a*, the assembler can easily guide the depression 22*a* into the gift wrap roll 16*a*. For example, in a method where the assembler targets the gift wrap roll 16*a* to be concentric with the depression 22*a* during insertion thereof, the assembler may vary from target at, for example, a distance equal to about $((D_{R1}-D_B)/2)$ in either direction, such that insertion of the circular portion 30*a* into the gift wrap roll 16*a* is successful despite being off-target. By providing this toleration for variance, manufacturing efficiency may be increased. During insertion, the cardboard tube core 32*a* then comes into sliding contact with the second frustoconical portion 28*a* and/or the first frustoconical portion 26*a*, which guide the cardboard tube core 32*a* to come into abutting contact with the base member 20 and/or to form a friction fit with the cylindrical portion 24*a*. The depressions 22*b-f* of the end cap 12 and the depressions (not designated) of the end cap 14 attach to the gift wrap rolls 1 6*a-f* in a similar fashion.

The end caps 12, 14 and the gift wrap rolls 16*a-f*, which are collectively referenced herein as an ensemble subassembly, are then packaged. For example, the assembler can insert the ensemble subassembly into the interior space 40 of the container 18, fold the lid flaps 42*a-d* into a closed position, and fasten the lid flaps 42*a-d* in the closed position with tape. After packaging, the multi-roll gift wrap ensemble 10 may be displayed for sale.

Figure 6:
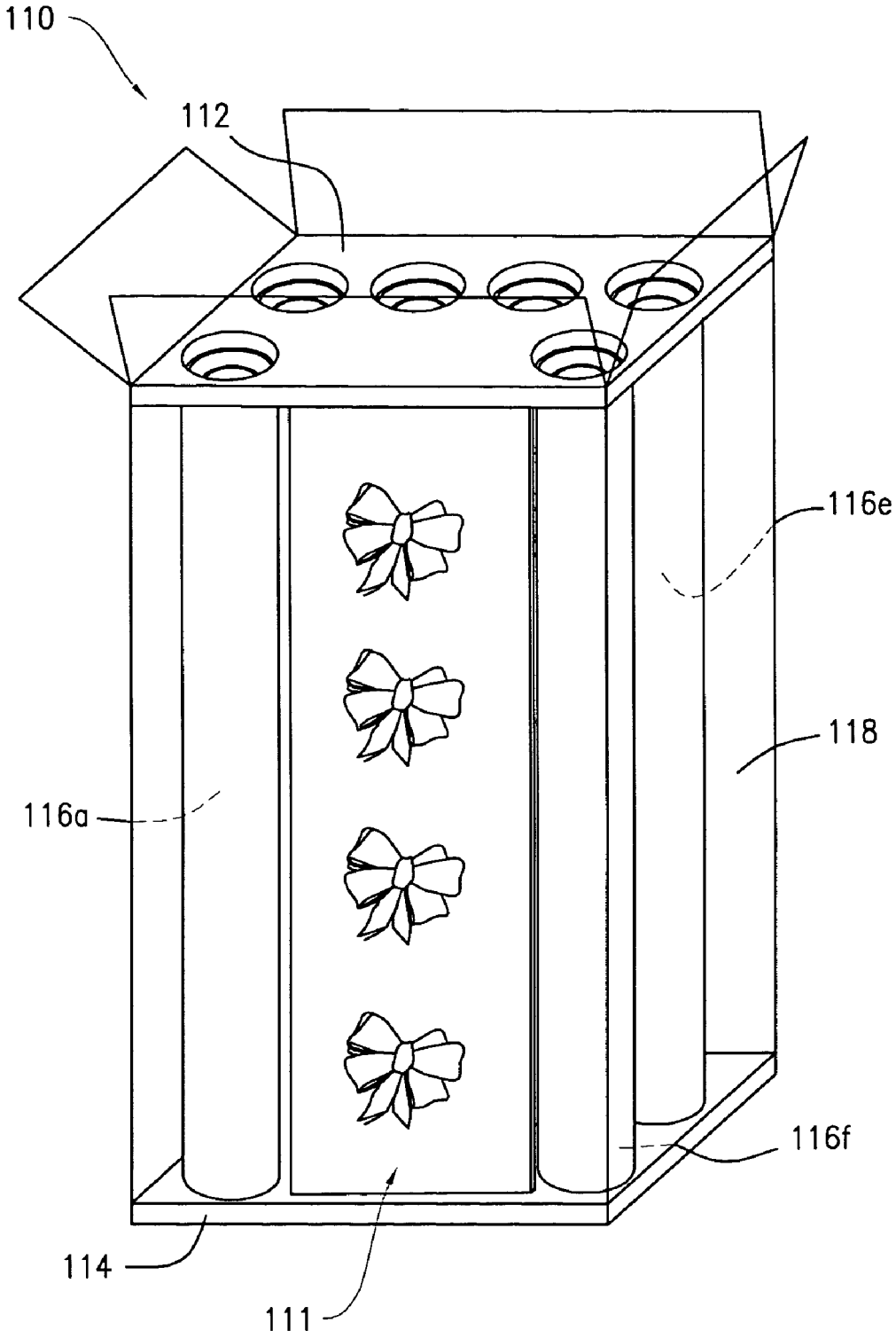
FIG. 6 is a perspective view of a multi-roll gift wrap ensemble constructed in accordance with a second exemplary embodiment of the present invention, the multi-roll gift wrap ensemble being shown to include end caps, gift wrap rolls, a chamber formed therebetween, a backing positioned in the chamber with decorative items, and a transparent container.
Figure 7:
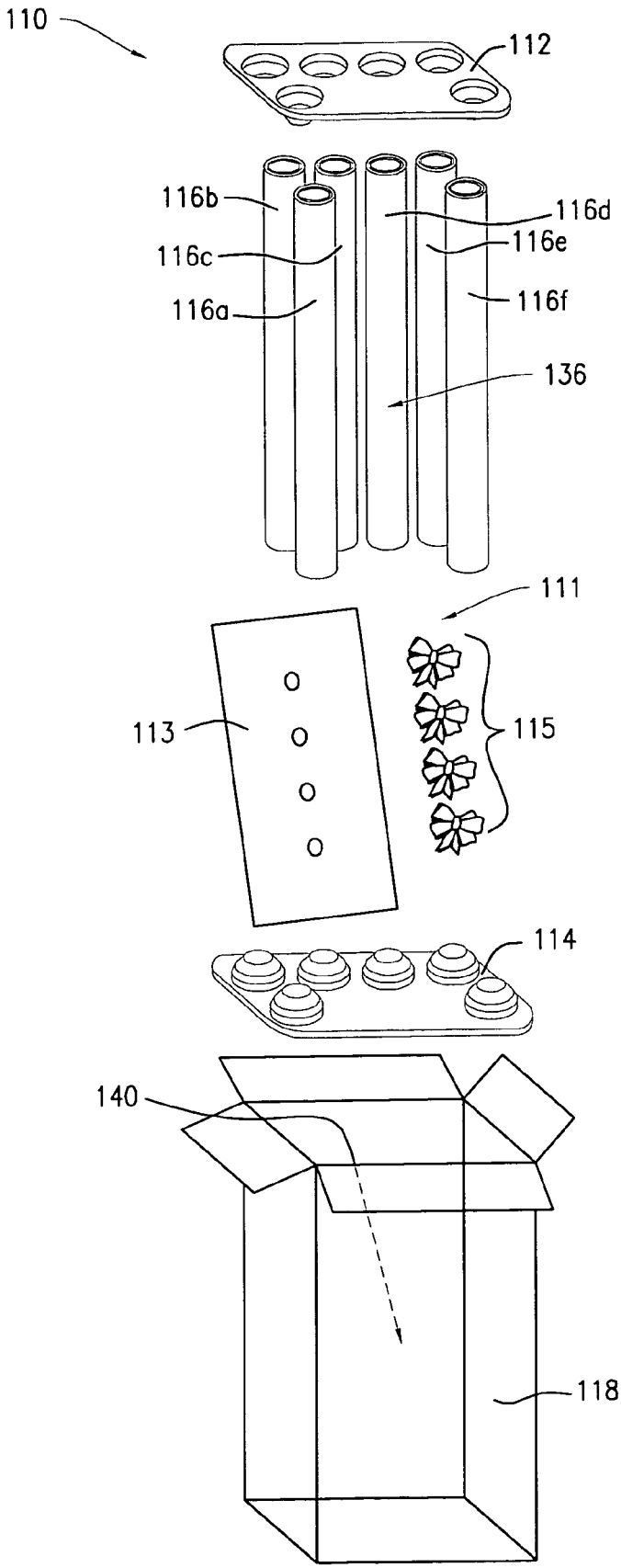
FIG. 7 is an exploded view of the multi-roll gift wrap ensemble of FIG. 6.

FIGS. 6 and 7 show a second exemplary embodiment of the present invention. Elements illustrated in FIGS. 6 and 7 which correspond substantially to the elements described above with reference to FIGS. 1-5 have been designated by corresponding reference numerals increased by one hundred. In addition, elements illustrated in FIGS. 6 and 7 which do not correspond to the elements described above with reference to FIGS. 1-5 have been designated by odd numbered reference numerals starting with reference number 111. The embodiment of the present invention shown in FIGS. 6 and 7 is constructed and used in manners consistent with the foregoing description of the multi-roll gift wrap ensemble 10 discussed in connection with FIGS. 1-5, unless it is stated otherwise.

Referring to FIGS. 6 and 7, there is shown a multi-roll gift wrap ensemble 110 constructed in an identical manner to multi-roll gift wrap ensemble 10, except that a display backing subassembly 111 has been positioned within the chamber 136. The display backing subassembly 111 includes a cardboard backing 113 and a plurality of decorative items 115

(e.g., bows, ribbon, tissue paper, gift tags, etc.) fastened thereto. The cardboard backing 113 extends between the end caps 112, 114 to form a friction fit therewith. In an exemplary method of the present invention, the display backing subassembly 111 is positioned within the chamber 136 between the end caps 112, 114 prior to the end caps 112, 114, the gift wrap rolls 116*a-f*, and the display backing subassembly 111 being inserted into the interior space 140 of the container 118.

Figure 8:
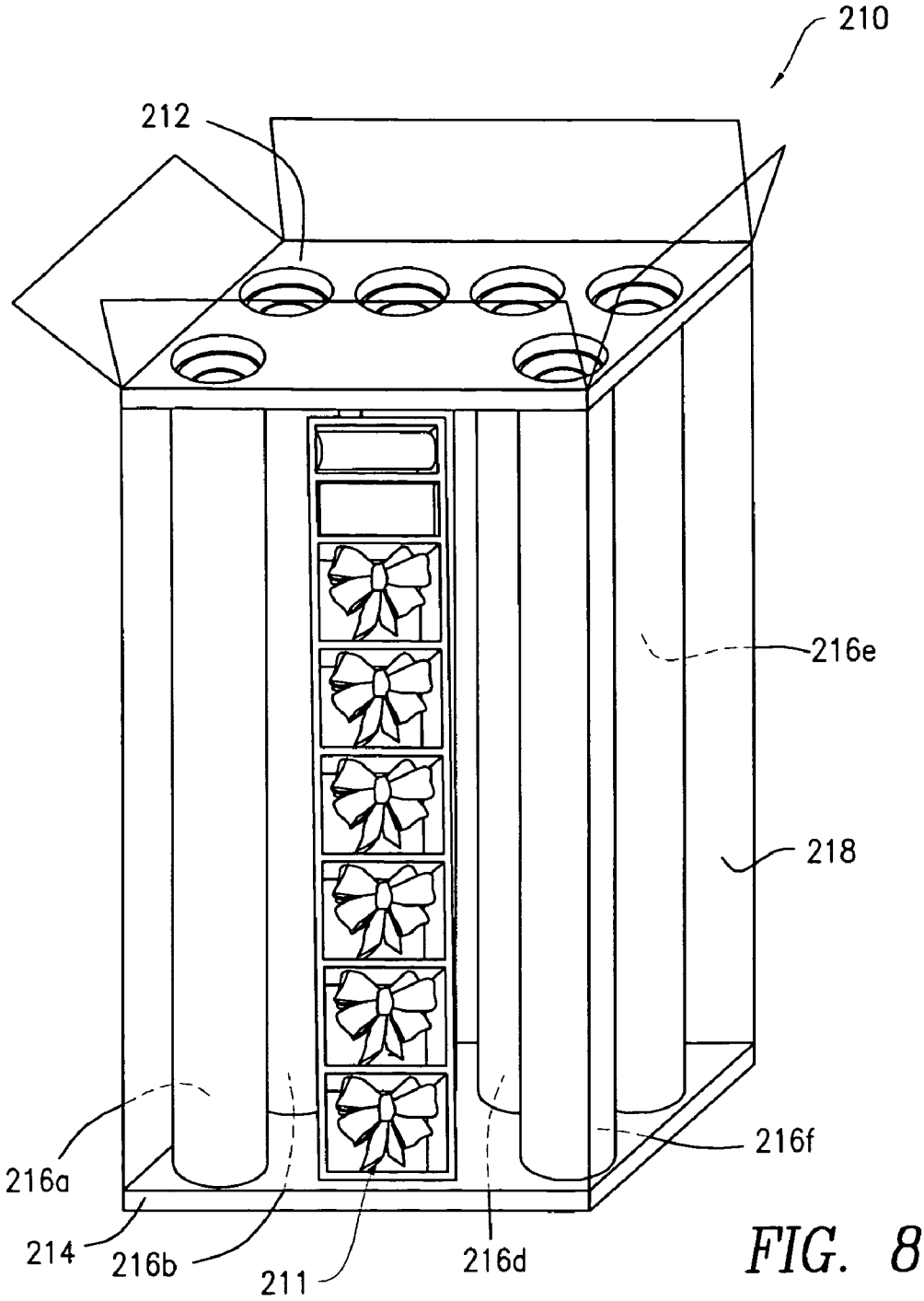
FIG. 8 is a perspective view of a multi-roll gift wrap ensemble constructed in accordance with a third exemplary embodiment of the present invention, the multi-roll gift wrap ensemble being shown to include end caps, gift wrap rolls, a chamber formed therebetween, a tray positioned in the chamber with decorative items, and a transparent container.
Figure 9:
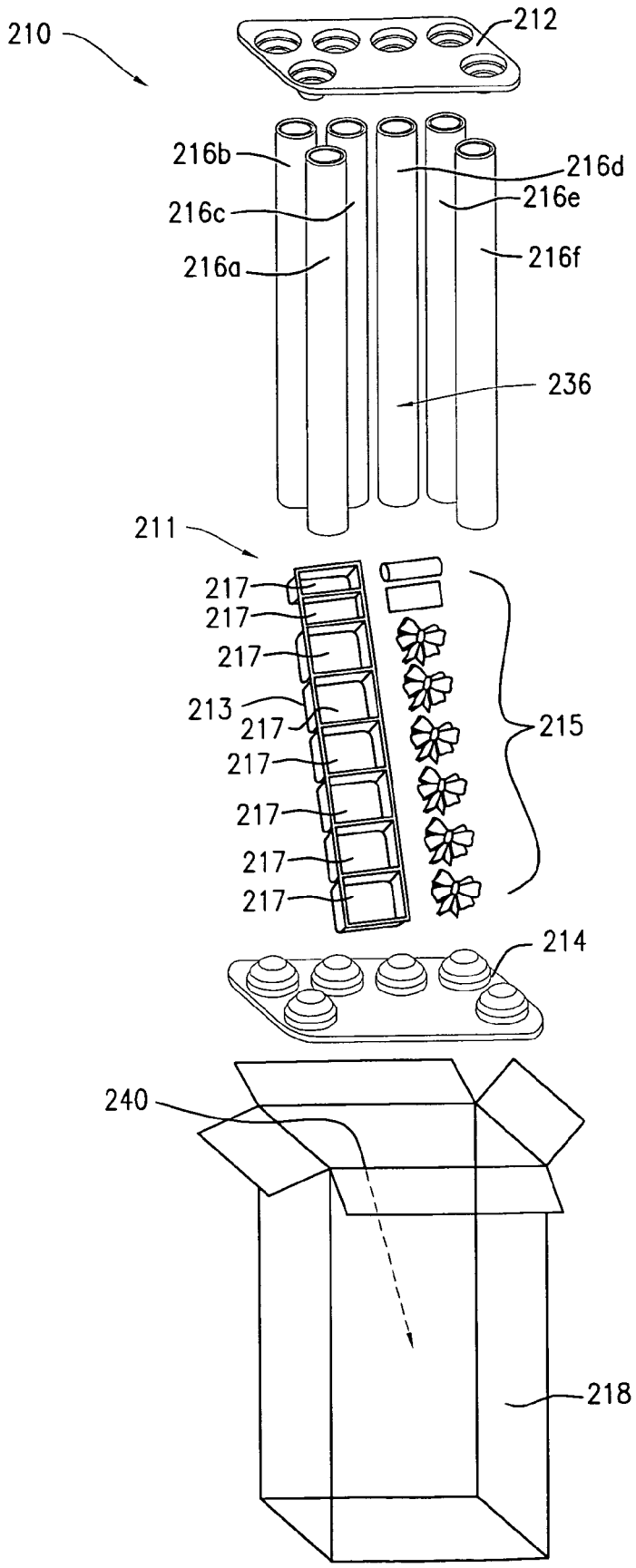
FIG. 9 is an exploded view of the multi-roll gift wrap ensemble of FIG. 8.

FIGS. 8 and 9 show a third exemplary embodiment of the present invention. Elements illustrated in FIGS. 8 and 9 which correspond substantially to the elements described above with reference to FIGS. 1-5 have been designated by corresponding reference numerals increased by two hundred. In addition, elements illustrated in FIGS. 8 and 9 which do not correspond to the elements described above with reference to FIGS. 1-5 have been designated by odd numbered reference numerals starting with reference number 211. The embodiment of the present invention shown in FIGS. 8 and 9 is constructed and used in manners consistent with the foregoing description of the multi-roll gift wrap ensemble 10 discussed in connection with FIGS. 1-5, unless it is stated otherwise.

Referring to FIGS. 8 and 9, there is shown a multi-roll gift wrap ensemble 210 constructed in an identical manner to multi-roll gift wrap ensemble 10, except that a display tray subassembly 211 is provided that includes a tray 213 and a plurality of decorative items 215 (e.g., bow, ribbon, gift tags). The tray 213 includes a plurality of compartments 217, and each one of the decorative items 215 are positioned within one of the compartments 217. The display tray subassembly 211 extends between the end caps 212, 214 such that the tray 213 forms a friction fit therewith. In an exemplary method of the present invention, the decorative items 215 are first positioned within the tray 213, and the display tray subassembly 211 is then positioned within the chamber 236. The display tray subassembly 211, the end caps 212, 214, and the gift wrap rolls 216*a-f* are then inserted into the interior space 240 of the container 218, such that each one of the decorative items 215 is confined by the container 218 within one of the compartments 217 corresponding thereto.

Figure 10:
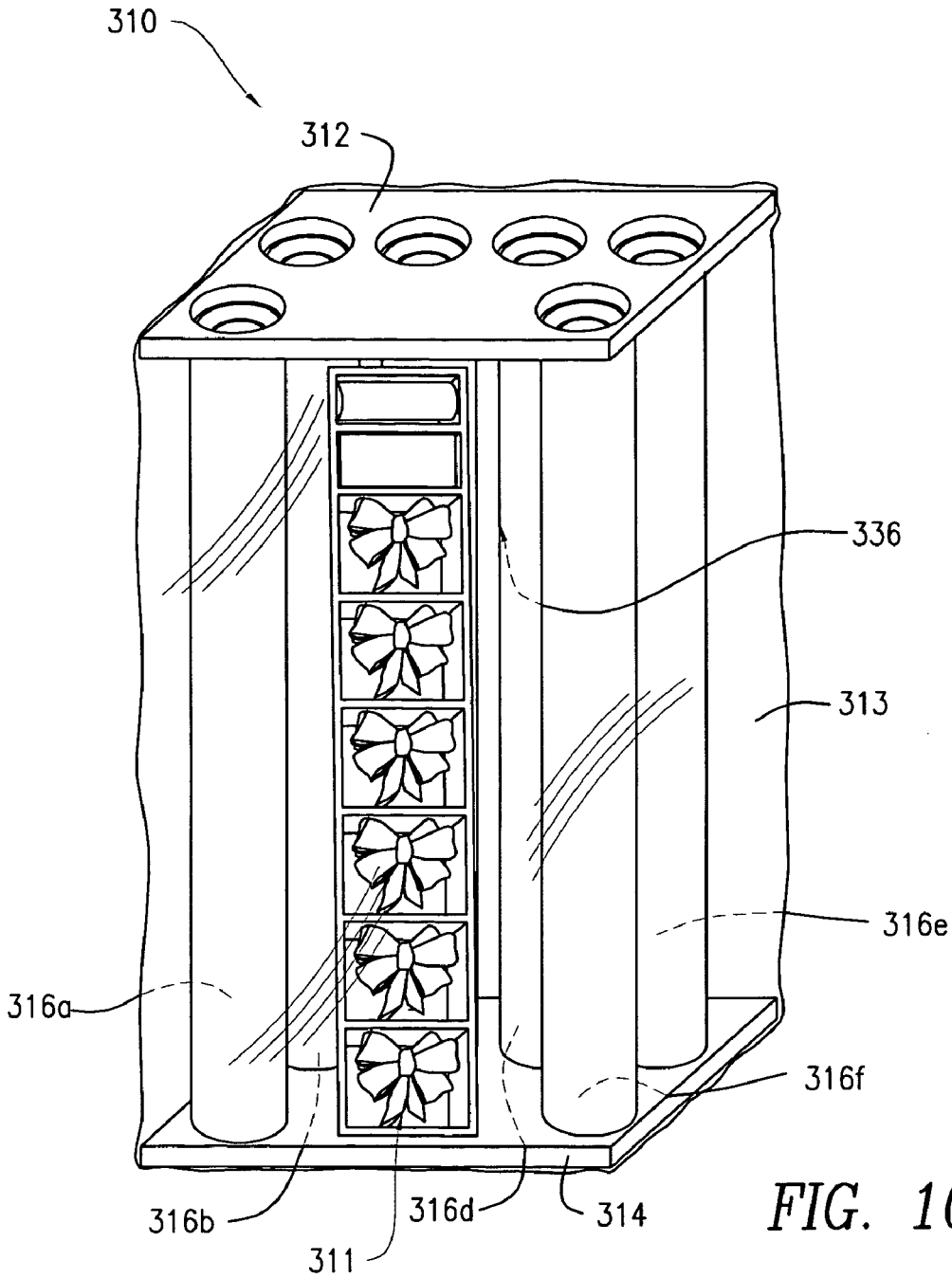
FIG. 10 is a perspective view of a multi-roll gift wrap ensemble constructed in accordance with a fourth exemplary embodiment of the present invention, the multi-roll gift wrap ensemble being shown to include end caps, gift wrap rolls, a chamber formed therebetween, a tray positioned in the chamber with decorative items, and shrink-wrap.

FIG. 10 shows a fourth exemplary embodiment of the present invention. Elements illustrated in FIG. 10 which correspond substantially to the elements described above with reference to FIGS. 1-5 have been designated by corresponding reference numerals increased by three hundred. In addition, elements illustrated in FIG. 10 which do not correspond to the elements described above with reference to FIGS. 1-5 have been designated by odd numbered reference numerals starting with reference number 311. The embodiment of the present invention shown in FIG. 10 is constructed and used in manners consistent with the foregoing description of the multi-roll gift wrap ensemble 10 discussed in connection with FIGS. 1-5, unless it is stated otherwise.

Referring to FIG. 10, there is shown a multi-roll gift wrap ensemble 310 constructed in an identical manner to multi-roll gift wrap ensemble 10, except that a display tray subassembly 311 is provided that includes a tray and a plurality of decorative items (e.g., bow, ribbon, gift tags). Similar to the multi-roll gift wrap ensemble 210 of FIGS. 8 and 9, the tray of the display tray subassembly 311 includes a plurality of compartments, and the decorative items are positioned therein. It is also noted that the multi-roll gift wrap ensemble 310 is not shown to include the container 18 of the multi-roll gift wrap ensemble 10, but that the display tray subassembly 311, the end caps 312, 314, and the gift wrap rolls 316*a-f* are packaged with a clear shrink-wrap 313.

Figure 11:
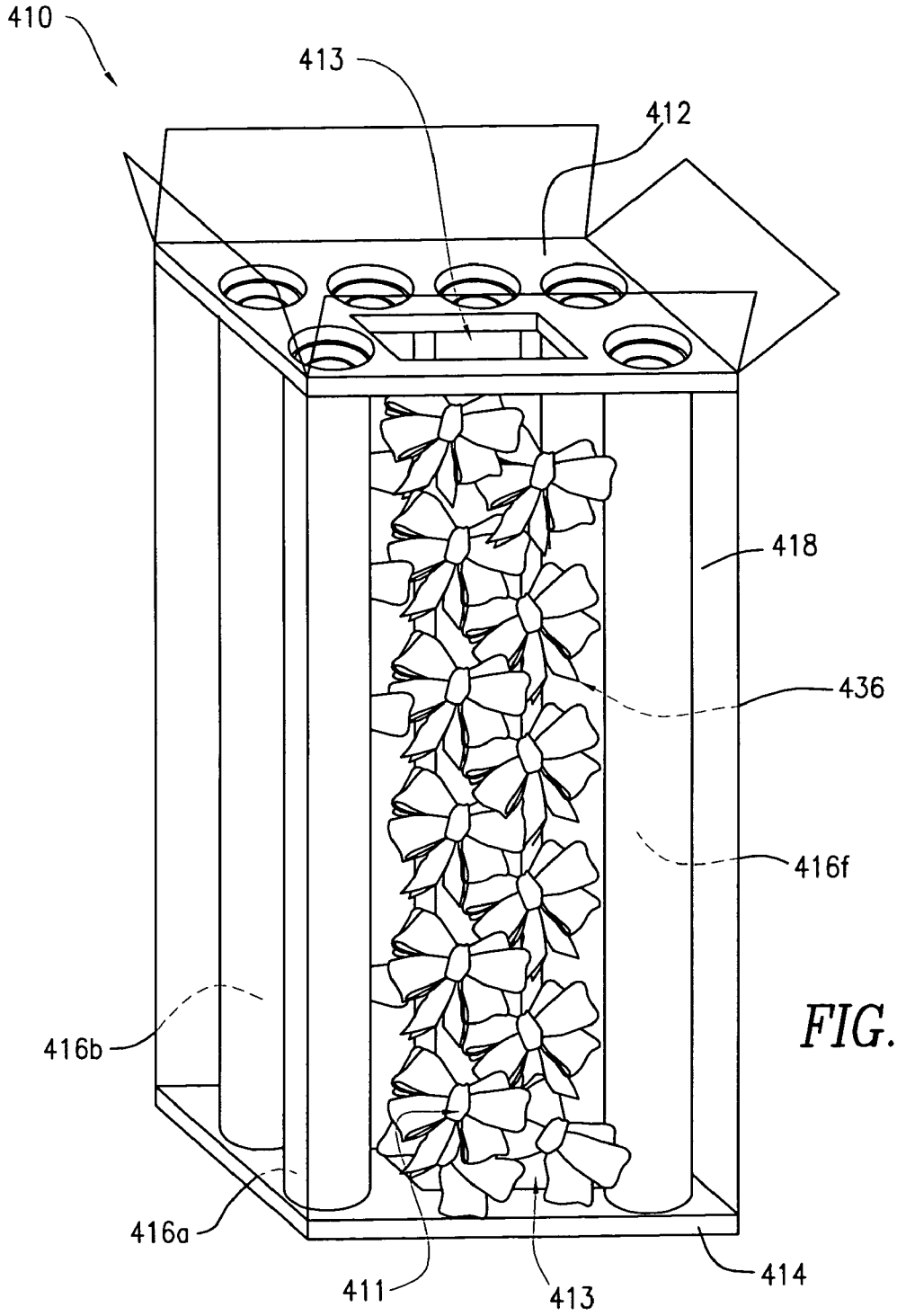
FIG. 11 is a perspective view of a multi-roll gift wrap ensemble constructed in accordance with a fifth exemplary embodiment of the present invention, the multi-roll gift wrap ensemble being shown to include a plurality of end caps each having a rectangular cutout, gift wrap rolls, a chamber formed therebetween, a plurality of decorative items positioned in the chamber, and a transparent container.
Figure 12:
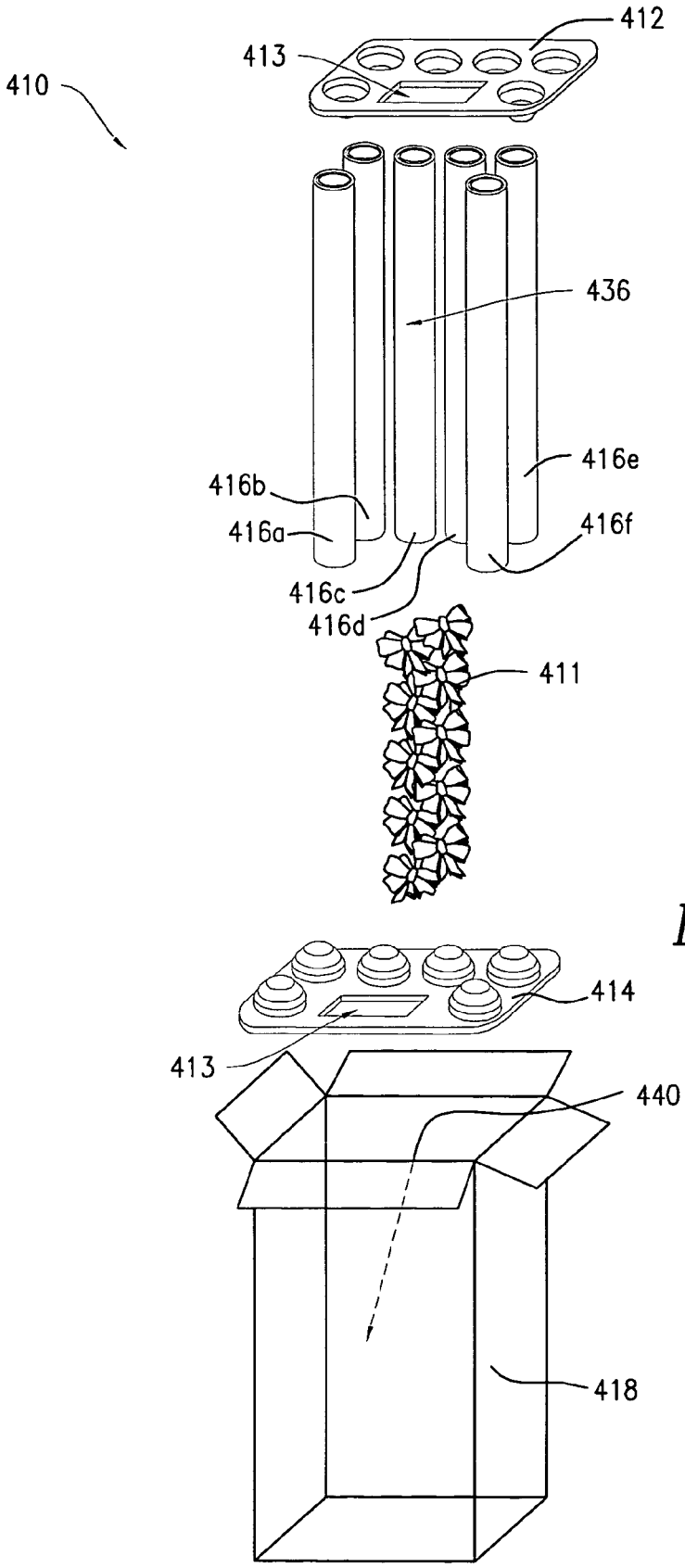
FIG. 12 is an exploded view of the multi-roll gift wrap ensemble of FIG. 11.

FIGS. 11 and 12 show a fifth exemplary embodiment of the present invention. Elements illustrated in FIGS. 11 and 12 which correspond substantially to the elements described above with reference to FIGS. 1-5 have been designated by corresponding reference numerals increased by four hundred. In addition, elements illustrated in FIGS. 11 and 12 which do not correspond to the elements described above with reference to FIGS. 1-5 have been designated by odd numbered reference numerals starting with reference number 411. The embodiment of the present invention shown in FIGS. 11 and 12 is constructed and used in manners consistent with the foregoing description of the multi-roll gift wrap ensemble 10 discussed in connection with FIGS. 1-5, unless it is stated otherwise.

Referring to FIGS. 11 and 12, there is shown a multi-roll gift wrap ensemble 410 constructed in an identical manner to multi-roll gift wrap ensemble 10, except that the decorative items 411 are positioned loosely in the chamber 436, and the end caps 412, 414 have rectangular cutouts 413 formed therethrough. In an exemplary method of the present invention, the gift wrap rolls 416*a-f* and the end caps 412, 414 are assembled with one another and inserted into the interior space 440 of the container 418. The decorative items 411 are then passed through the rectangular cutout 413 of the end cap 412 for storage and display in the chamber 436. The decorative items 411 are confined in the chamber 436 between the gift wrap rolls 416*a-f*, the end caps 412, 414, and the container 418, such that the decorative items 411 are visible through the container 418. Although there are many manufacturing and economic advantages for the end cap 412 and the end cap 414 to be substantially identical, it is not required for the ends cap 414, for example, to have the rectangular cutout 413 formed therein.

Figure 13:
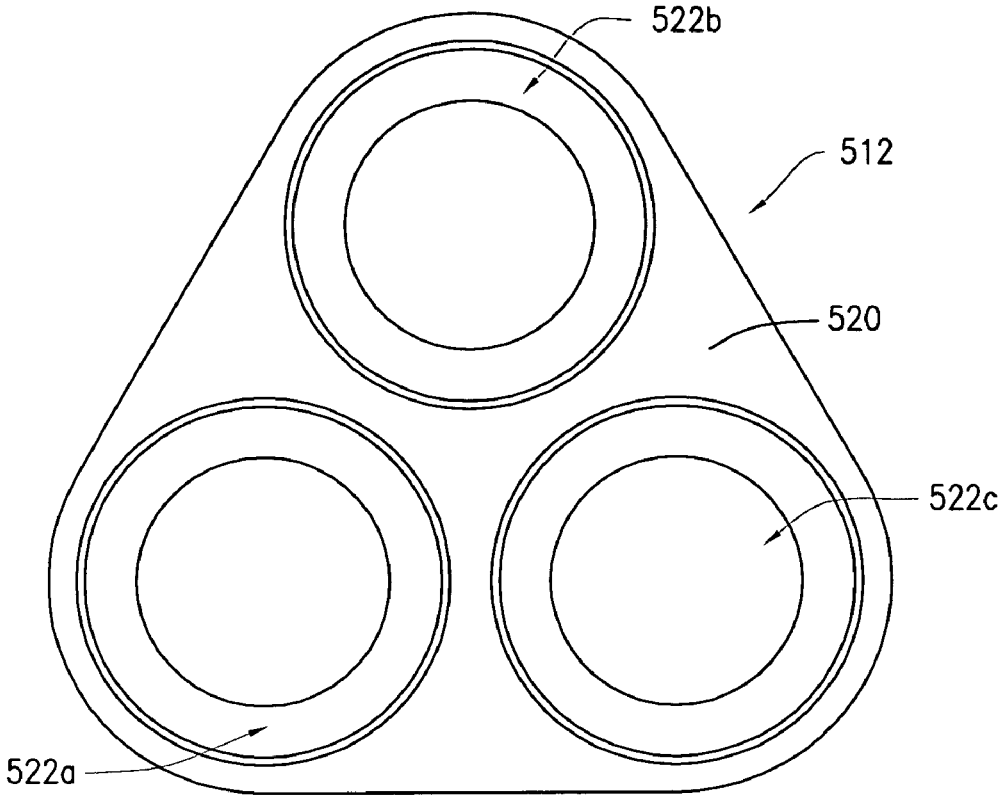
FIG. 13 is a top view of a three-roll end cap, each depression thereof being shown to include a cylindrical portion, a frustoconical portion extending therefrom, and a circular portion enclosing the frustoconical portion.
Figure 14:
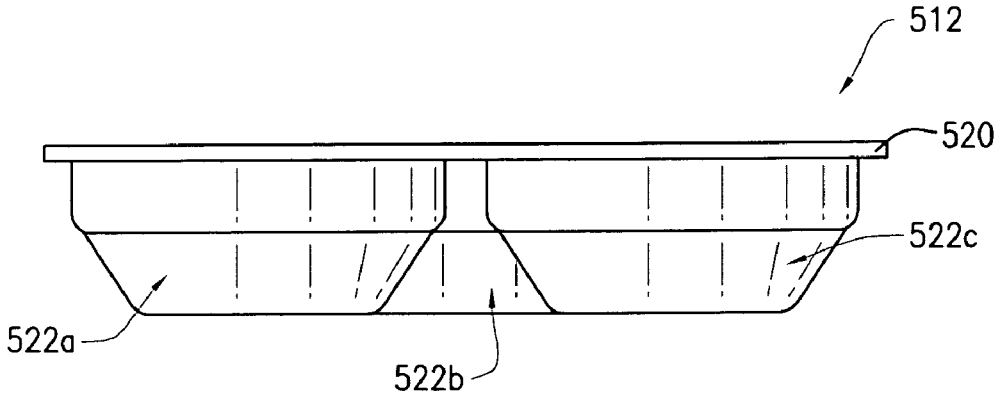
FIG. 14 is a front view of the three-roll end cap of FIG. 13.
Figure 15:
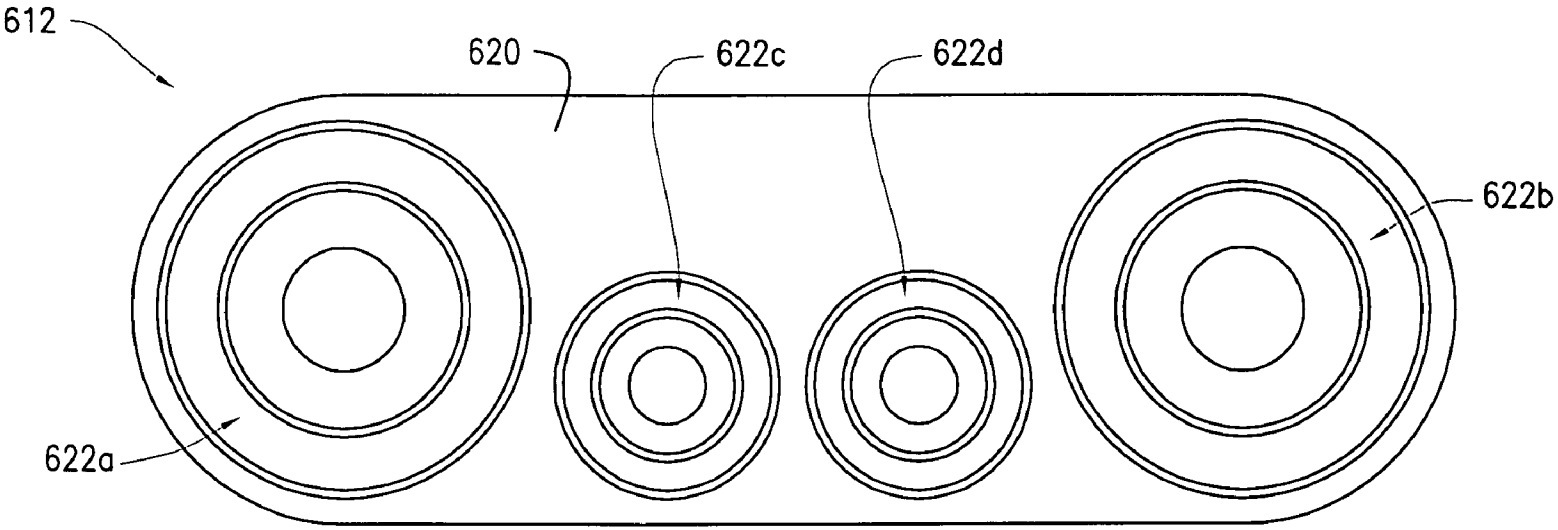
FIG. 15 is a top view of a four-roll end cap having two large depressions and two small depressions.
Figure 16:
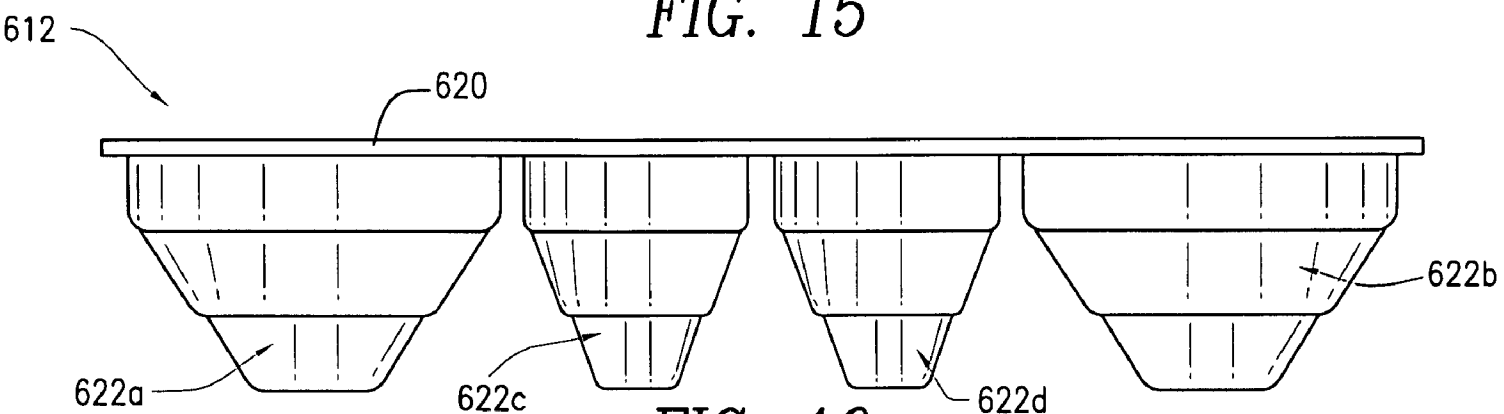
FIG. 16 is a front view of the four-roll end cap of FIG. 15.

It is noted that the present invention is susceptible to numerous modifications and variations. Embodiments of the present invention can include any number of varying gift wrap rolls that can be grouped together using one or more end caps. Referring to FIGS. 13 and 14, for example, a three-roll end cap 512 is provided that is triangularly-shaped and has three depressions 522*a-c*. As shown in FIGS. 13 and 14, it is not required for each one of the depressions 522*a-c* to have a plurality of frustoconical surfaces, but the depressions of the present invention can include, a single, continuous frustoconical surface (and/or single or multiple conical surfaces). Referring to FIGS. 15 and 16, a four-roll end cap 612 is shown having two depressions 622*a-b* and two depressions 622*c-d*, wherein the diameter at the cylindrical portion (not designated) of each one of the depressions 622*a-b* is greater than the diameter at the cylindrical portion (not designated) of each one of the depressions 622*c-d*. In this regard, it is illustrated that the end cap 612 is adapted for assembly with a plurality of gift wrap rolls having a first inner diameter and a plurality of gift wrap rolls having a second inner diameter less than the first inner diameter.

Figure 17:
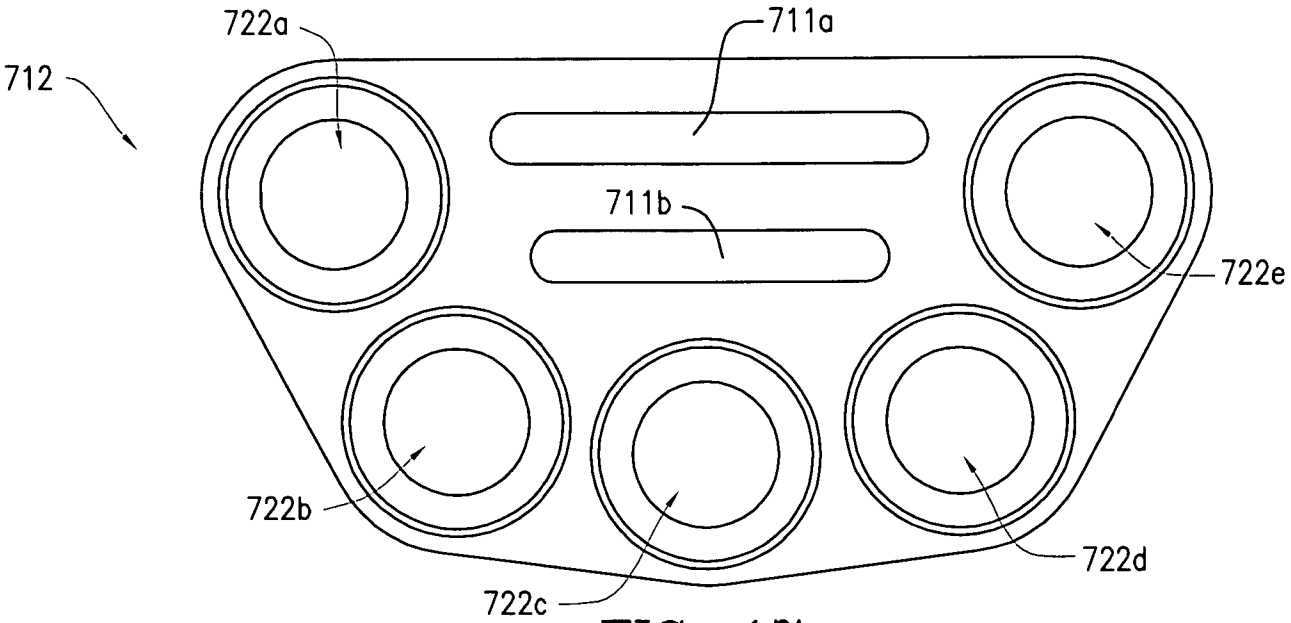
FIG. 17 is a bottom view of a five-roll end cap having a plurality of bosses formed therein.
Figure 18:
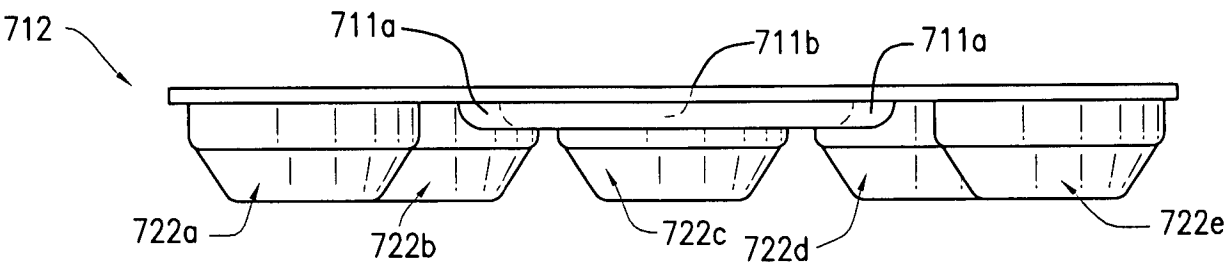
FIG. 18 is a front view of the five-roll end cap of FIG. 17.

Referring to FIGS. 17 and 18, a five-roll end cap 712 can be provided having a plurality of bosses 711*a-b* formed therein and five depressions 722*a-e*. The bosses 711*a-b* are particularly useful, for example, in embodiments of the invention where a display tray subassembly is provided within the chamber of the multi-roll gift wrap ensemble. In this regard, one or more of the bosses 711*a-b* abuts the display tray subassembly to add stability thereto by inhibiting undesired motion within the container or other packaging.

It will be understood that the embodiments described herein are merely exemplary and that a person skilled in the art may make many variations and modifications without departing from the spirit and scope of the invention. All such variations and modifications, including those discussed above, are intended to be included within the scope of the invention as defined in the appended claims.

What is claimed is:

1. A gift wrap ensemble, comprising an end cap including a base member and a plurality of depressions extending from said base member; a decorative item; a plurality of gift wrap rolls receiving said depressions and forming a chamber having said decorative item positioned therein; and packaging enclosing said chamber; wherein said packaging is at least one of transparent and translucent such that said decorative item is visually-perceptible from outside said packaging.

2. The gift wrap ensemble of claim 1, wherein said plurality of gift wrap rolls form a friction fit with said plurality of depressions.

3. The gift wrap ensemble of claim 1, wherein said packaging is a container having an interior space in which said end cap, said plurality of gift wrap rolls, and said decorative item are positioned.

4. The gift wrap ensemble of claim 1, wherein said packaging is shrink-wrap.

5. The gift wrap ensemble of claim 1, wherein said decorative item is one of a ribbon, a bow, tissue paper, and a gift tag.

6. The gift wrap ensemble of claim 1, including a second end cap having a second base member and a second plurality of depressions extending from said second base member, wherein said plurality of gift wrap rolls receives said second plurality of depressions.

7. The gift wrap ensemble of claim 1, wherein at least one of said plurality of depressions is tapered.

8. The gift wrap ensemble of claim 1, wherein at least one of said plurality of depressions is stepped.

9. The gift wrap ensemble of claim 1, wherein at least one of said plurality of depressions includes a conical portion received by one of said plurality of gift wrap rolls.

10. The gift wrap ensemble of claim 9, wherein said conical portion is frustoconical.

11. The gift wrap ensemble of claim 9, wherein said conical portion has a first radius at a first end thereof, and wherein said at least one of said plurality of depressions includes a second conical portion having a second end adjacent said first end and having a second radius less than said first radius.

12. The gift wrap ensemble of claim 11, wherein at least one of said conical portion and said second conical portion is frustoconical.

13. The gift wrap ensemble of claim 1, including a backing positioned within said chamber and fastened to said decorative item.

14. The gift wrap ensemble of claim 13, wherein said backing forms a friction fit with said end cap.

15. The gift wrap ensemble of claim 1, including a display tray positioned within said chamber and having a compartment in which said decorative item is positioned.

16. The gift wrap ensemble of claim 1, wherein said base has a hole formed therethrough for receiving said decorative item into said chamber.

17. A gift wrap ensemble, comprising a first end cap including a first base member and a first plurality of depressions extending therefrom; a second end cap including a second base member and a second plurality of depressions extending therefrom; a plurality of gift wrap rolls forming a chamber therebetween, receiving at a first end said first plurality of depressions, and receiving at a second end said second plurality of depressions; a decorative item positioned within said chamber; and packaging enclosing said decorative item within said chamber, said decorative item being visually-perceptible from outside said packaging.

18. The gift wrap ensemble of claim 17, wherein at least one of said first base and said second base has a hole formed therethrough for receiving said decorative item into said chamber.

19. The gift wrap ensemble of claim 17, wherein said packaging is a container having an interior space in which said end caps, said plurality of gift wrap rolls, and said decorative item are positioned.

20. The gift wrap ensemble of claim 17, wherein said packaging is shrink-wrap.

21. The gift wrap ensemble of claim 17, wherein said decorative item is one of a ribbon, a bow, tissue paper, and a gift tag.

22. The gift wrap ensemble of claim 17, wherein at least one of said depressions is tapered.

23. The gift wrap ensemble of claim 17, wherein at least one of said depressions is stepped.

24. The gift wrap ensemble of claim 17, wherein at least one of said depressions includes a conical portion received by one of said plurality of gift wrap rolls.

25. The gift wrap ensemble of claim 17, including a backing positioned within said chamber and fastened to said decorative item.

26. The gift wrap ensemble of claim 17, including a display tray positioned within said chamber and having a compartment in which said decorative item is positioned.

* * * * *

UNITED STATES PATENT AND TRADEMARK OFFICE

CERTIFICATE OF CORRECTION

PATENT NO. : 7,665,612 B2
APPLICATION NO. : 11/645221
DATED : February 23, 2010
INVENTOR(S) : Gary L. Turner It is certified that error appears in the above-identified patent and that said Letters Patent is hereby corrected as shown below:

In Column 2, line 10, "34" should be -- 3-4 --.

Signed and Sealed this

Tenth Day of August, 2010

David J. Kappos

David J. Kappos
*Director of the United States Patent and Trademark Office*